US009200841B2

(12) United States Patent
Heo et al.

(10) Patent No.: US 9,200,841 B2
(45) Date of Patent: Dec. 1, 2015

(54) CLOTHES DRYER

(71) Applicant: LG ELECTRONICS INC., Seoul (KR)

(72) Inventors: Seonil Heo, Changwon-Si (KR); Kiwook Jung, Changwon-Si (KR); Junseok Lee, Changwon-Si (KR)

(73) Assignee: LG ELECTRONICS INC., Seoul (KR)

( * ) Notice: Subject to any disclaimer, the term of this patent is extended or adjusted under 35 U.S.C. 154(b) by 138 days.

(21) Appl. No.: 13/888,739

(22) Filed: May 7, 2013

(65) Prior Publication Data

US 2013/0305553 A1 Nov. 21, 2013

(30) Foreign Application Priority Data

May 15, 2012 (KR) ..... 10-2012-0051605

(51) Int. Cl.

| | |
|---|---|
| ***D06F 58/20*** | (2006.01) |
| ***F26B 23/00*** | (2006.01) |
| ***D06F 58/02*** | (2006.01) |
| ***D06F 58/24*** | (2006.01) |

(52) U.S. Cl.

CPC ..... *F26B 23/001* (2013.01); *D06F 58/02* (2013.01); *D06F 58/206* (2013.01); *D06F 58/24* (2013.01)

(58) Field of Classification Search

CPC ..... F26B 11/00; F26B 21/00; F26B 21/10; D06F 58/00; D06F 58/20; D06F 58/22

USPC ..... 34/595, 601, 606, 610; 68/19, 20; 62/310, 314, 470, 473

See application file for complete search history.

(56) References Cited

U.S. PATENT DOCUMENTS

| | | | | | |
|---|---|---|---|---|---|
| 1,819,861 | A | * | 8/1931 | Bergdoll | 62/219 |
| 2,427,971 | A | * | 9/1947 | McNeill, Jr. | 414/717 |
| 2,463,363 | A | * | 3/1949 | Dunkley | 426/314 |
| 2,490,951 | A | * | 12/1949 | Dunkley | 426/314 |
| 2,660,869 | A | * | 12/1953 | McDonald | 68/18 R |
| 2,777,534 | A | * | 1/1957 | McDonald | 96/112 |
| 3,177,675 | A | * | 4/1965 | Kogel | 62/148 |
| 4,759,313 | A | * | 7/1988 | Dye | 122/32 |
| 4,907,420 | A | * | 3/1990 | Mahanay et al. | 62/291 |
| 4,949,477 | A | * | 8/1990 | Geiger | 34/604 |
| 5,121,611 | A | * | 6/1992 | Broderdorf et al. | 62/374 |

(Continued)

FOREIGN PATENT DOCUMENTS

| | | | | |
|---|---|---|---|---|
| CN | 102292496 | A | 12/2011 | |
| EP | 1584734 | A2 * | 10/2005 | D06F 58/24 |

(Continued)

OTHER PUBLICATIONS

European Search Report dated Aug. 12, 2013.

(Continued)

*Primary Examiner* — Stephen M Gravini
(74) *Attorney, Agent, or Firm* — KED & Associates, LLP

(57) ABSTRACT

A clothes dryer is provided. The clothes dryer may include a main body having a drum rotatably installed therein, a circulation channel formed in the main body, the circulation channel defining a path of air that flows through the drum to dry an object to be dried, and a heat pump system having an evaporator, a compressor, an expansion apparatus, and a condenser, the heat pump system cooling and heating air that flows through the circulation channel. The evaporator may be mounted in the circulation channel, and a 'U' trap may be positioned below the evaporator in the circulation channel.

14 Claims, 4 Drawing Sheets

(56) References Cited

U.S. PATENT DOCUMENTS

| | | | | |
|---|---|---|---|---|
| 5,156,006 | A * | 10/1992 | Broderdorf et al. | 62/46.1 |
| 5,333,677 | A * | 8/1994 | Molivadas | 165/272 |
| 5,481,886 | A * | 1/1996 | Hasegawa et al. | 62/285 |
| 6,314,601 | B1 * | 11/2001 | McClain et al. | 8/158 |
| 7,284,388 | B2 | 10/2007 | Yoshida | |
| 2006/0053818 | A1 * | 3/2006 | Yoshida | 62/285 |
| 2007/0072538 | A1 * | 3/2007 | Strock | 454/341 |
| 2008/0190128 | A1 * | 8/2008 | Hayase | 62/288 |
| 2010/0192397 | A1 * | 8/2010 | Kim et al. | 34/73 |
| 2012/0085691 | A1 * | 4/2012 | Cummins | 210/192 |
| 2013/0305553 | A1 * | 11/2013 | Heo et al. | 34/86 |

FOREIGN PATENT DOCUMENTS

| | | | |
|---|---|---|---|
| EP | 2 103 732 | * | 9/2009 |
| EP | 2 270 274 | | 1/2011 |
| EP | 2 415 927 | | 2/2012 |
| EP | 2 664 705 | A1 * | 11/2013 |
| EP | 2 784 207 | A1 * | 10/2014 |
| JP | 5-87469 | | 4/1993 |
| WO | WO 2006/054431 | | 5/2006 |

OTHER PUBLICATIONS

Chinese Office Action dated Jan. 30, 2015 issued in Application No. 201310178989.0 (Original Office Action with English Translation).

* cited by examiner

CLOTHES DRYER

CROSS-REFERENCE TO RELATED APPLICATION(S)

This application claims priority to Korean Application No. 10-2012-0051605, filed in Korea on May 15, 2012, the contents of which is incorporated by reference herein in its entirety.

BACKGROUND

1. Field

A clothes dryer is disclosed herein.

2. Background

Clothes dryers are known. However, they suffer from various disadvantages.

BRIEF DESCRIPTION OF THE DRAWINGS

Embodiments will be described in detail with reference to the following drawings in which like reference numerals refer to like elements, wherein.

DETAILED DESCRIPTION

Figure 1:
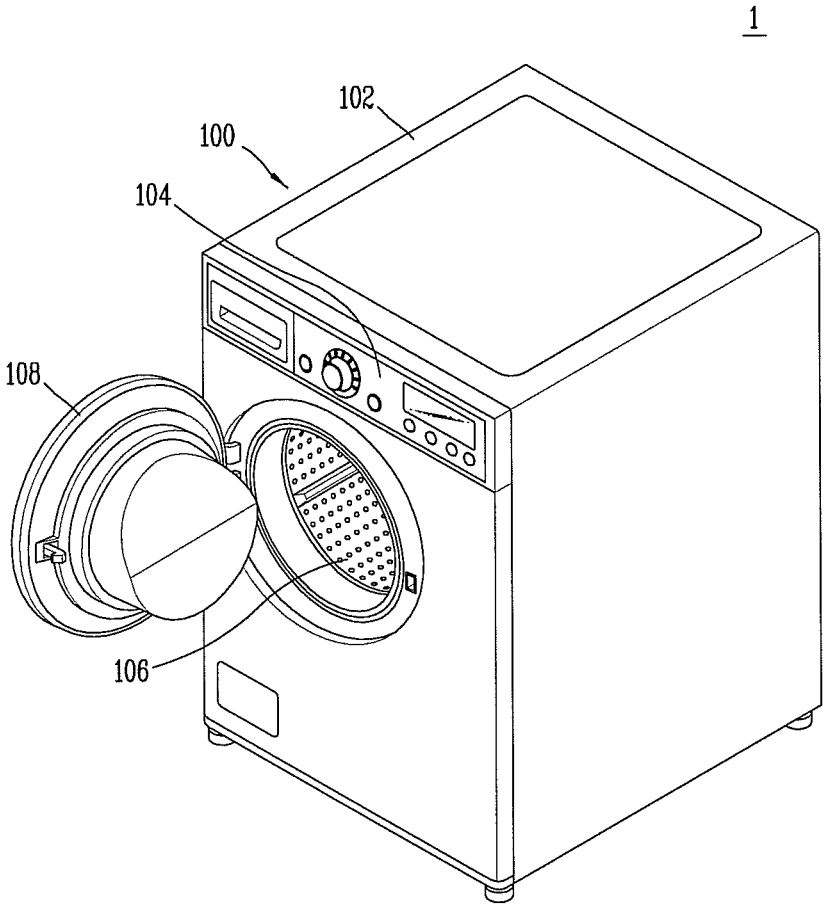
FIG. 1 is a schematic view of a clothes dryer in accordance with an embodiment.

Description will now be given in detail of the embodiments, with reference to the accompanying drawings. For the sake of brief description with reference to the drawings, the same or equivalent components will be provided with the same or like reference numbers, and repetitive description thereof will not be repeated.

In general, a clothes treating apparatus having a drying function, such as a washing machine or a drying machine that dries laundry by receiving laundry, which is completely washed and dehydrated, into a drum, supplying hot air into the drum, and evaporating moisture of the laundry. For example, a laundry drying machine may include a drum rotatably installed in a main body that receives laundry therein, a drive motor that drives the drum, a blowing fan that blows air into the drum, and a heater that heats air introduced into the drum. The heater may use thermal energy generated using electric resistance or heat of combustion generated by burning gas.

The air discharged out of the drum of the drying machine may contain moisture of the laundry within the drum, so as to become hot and humid. Such drying machines may be classified, according to how the hot humid air is processed, into a circulating type drying machine, in which hot humid air is circulated without being discharged out of the drying machine and is cooled below a dew point temperature by a heat exchanger, such that moisture contained within the hot humid air may be condensed for resupply, and an exhaust type drying machine, in which hot humid air having passed through the drum is discharged directly outside of the drying machine.

For the circulating type drying machine, in order to condense the air discharged out of the drum, the air has to be cooled below the dew point and then heated up by the heater prior to being resupplied into the drum. When a heater is used, a heat exchanger may be separately needed to condense the hot humid air discharged from the drum, and thermal energy supplied by the heater may be discharged to the outside due to heat exchange with the heat exchanger. The circulating type drying machine has an advantage of sufficiently supplying thermal energy needed using the heater, but causes problems of lowering thermal efficiency and raising energy consumption. Also, for air circulation, as moisture has to be fully removed, a size of the heat exchanger or a drying time may increase.

Even for the exhaust type drying machine, after hot humid air is discharged to the outside, external air at room temperature has to be introduced and heated up to a required temperature by the heater. When a heater is used in the exhaust type drying machine, it has advantages in that a separate heat exchanger is not required and a drying time may be reduced due to fully supplying necessary thermal energy using the heater. However, air at a high temperature is discharged directly to the outside containing thermal energy transferred by the heater. This may result in lowered thermal efficiency and high energy consumption.

Therefore, recently, a drying machine capable of enhancing energy efficiency by restoring unused energy from air discharged out of a drum and using the restored air to heat air to be supplied into the drum has been introduced. One example of such a drying machine is a drying machine having a heat pump system. The heat pump system may include two heat exchangers, a compressor, and an expansion apparatus. A refrigerant circulating in a system may adsorb energy contained in hot air discharged, and the adsorbed energy may be used to heat air to be supplied into the drum. This may result in an increase in energy efficiency.

In more detail, the heat pump system may include an evaporator disposed at an outlet side of the drum, and a condenser disposed at an inlet side of the drum. A refrigerant may adsorb thermal energy through the evaporator and be heated up to a high temperature and high pressure by the compressor. Afterwards, the thermal energy of the refrigerant may be transferred to air introduced into the drum through the condenser. This may allow for generation of hot air using unused dissipated energy.

For a drying machine using a heat pump system, energy efficiency and a drying time may depend on a degree of heat exchange between contacted air and a refrigerant that passes through the evaporator and the condenser. That is, when the contacted air efficiently exchanges heat with the refrigerant of the heat pump system and a large amount of heat is transferred or received, energy efficiency may be improved by a similar amount.

The drying machine using the heat pump system may include a channel in the form of a duct within a cabinet, which may function as a main body, such that air may flow along the defined channel. An evaporator and a condenser may be provided in the duct-shaped channel, so as to contact an air channel.

In order to improve energy efficiency of the drying machine, a more smooth contact between air and the evaporator or condenser within the duct has to be ensured. However, when the evaporator and the condenser are mounted in the duct, they have to be located a gap apart from a wall surface of the duct to some degree. Consequently, when air leaks through the gap, it may lower heat exchange efficiency of the evaporator and the condenser, causing energy efficiency of the drying machine to be lowered.

FIG. 1 is a schematic view of a clothes dryer in accordance with an embodiment. As shown in FIG. 1, a clothes dryer 1 may include a cabinet 100, which may function as a main body of the clothes dryer and may have an approximately rectangular shape. A top plate 102 may be placed on an upper surface of the cabinet 100, and a control panel 104 may be provided on an upper portion of a front surface of the cabinet 100, so as to control various functions of the dryer and display an operating state. An introduction opening 106, through which clothes or other objects to be dried may be put into the dryer, may be formed through a front surface of the cabinet 100, and a door 108 to open and close the introduction opening 106 may be installed adjacent to the introduction opening 106.

Figure 2:
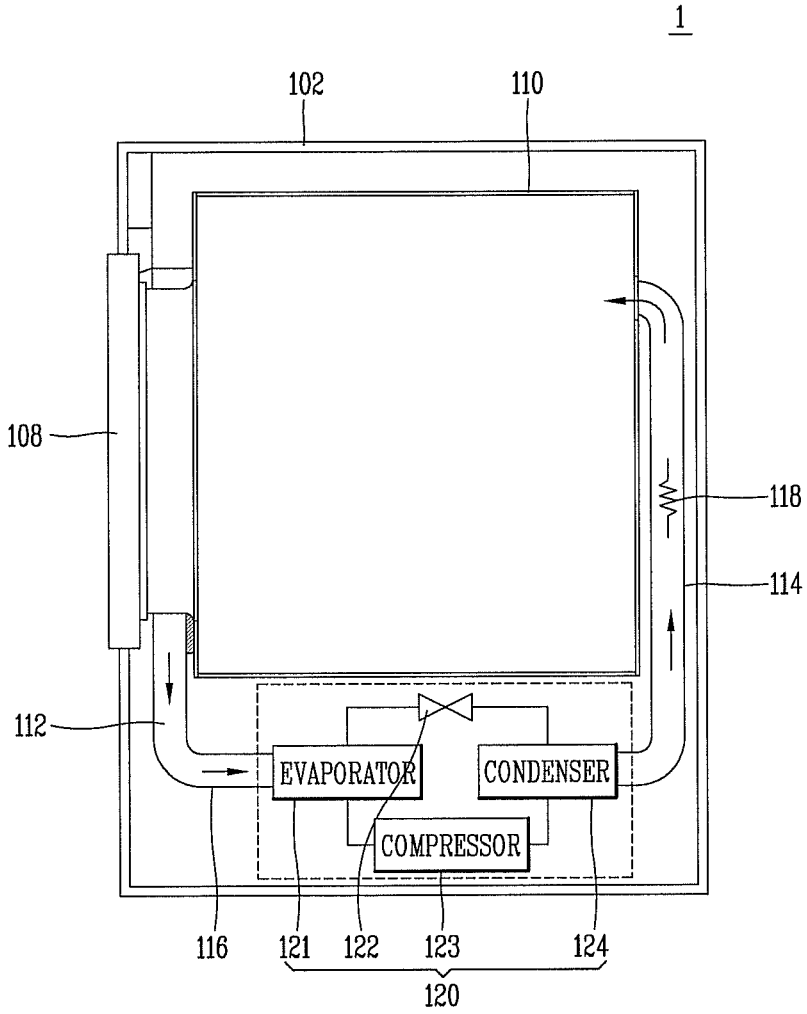
FIG. 2 is a schematic view of a heat pump system in the clothes dryer of FIG. 1.
Figure 3:
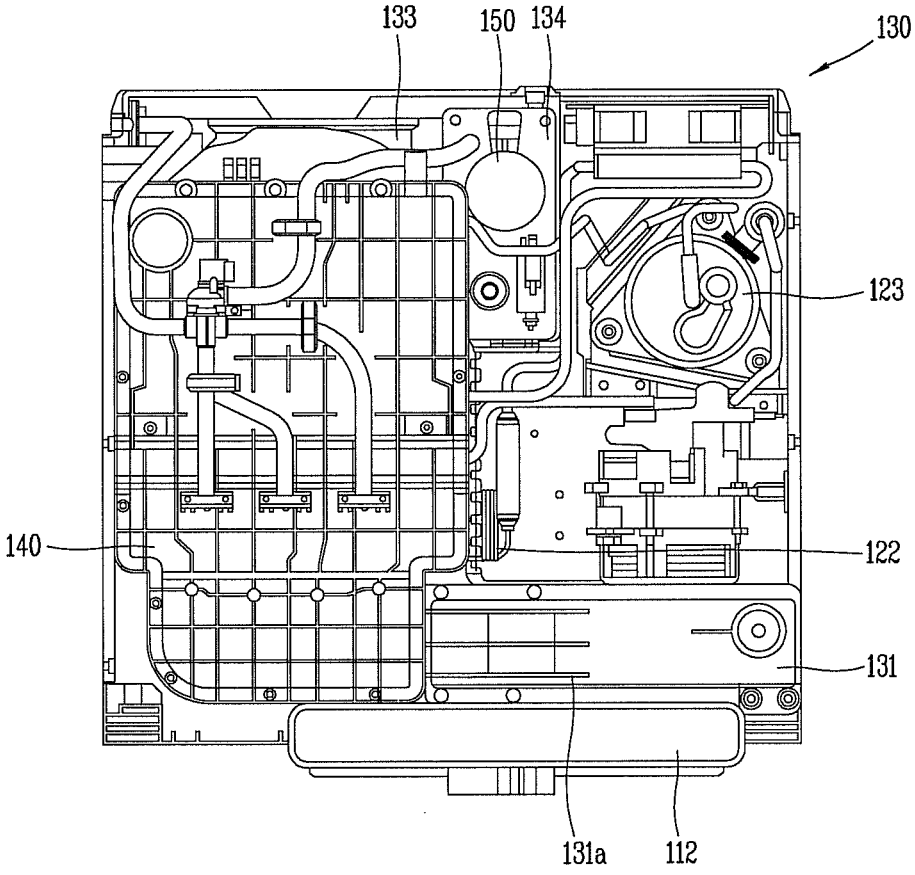
FIG. 3 is a schematic view showing various components disposed within a base of the clothes dryer of FIG. 1.

FIG. 2 is a schematic view of a heat pump system in the clothes dryer of FIG. 1. FIG. 3 is a schematic view showing various components disposed within a base of the clothes dryer of FIG. 1.

As shown in FIGS. 2 and 3, the cabinet 100 may include a drum 110 rotatably installed therein to receive clothes or other objects to be dried placed therein, and a lint filter mounting portion 112, which may be formed at a lower side of a front surface of the drum 110. Air exhausted from the drum 110 may be introduced into the lint filter mounting portion 112. The lint filter mounting portion 112 may provide a space in which a lint filter (not shown), which filters off lint contained in hot air discharged from the drum 110, may be installed and may also partially form a channel through which hot air may flow.

A circulation channel 116 may be provided at a downstream side of the lint filter mounting portion 112, and a portion of a heat pump system 120 may be installed within the circulation channel 116. The heat pump system 120 may include an evaporator 121, an expansion valve (i.e., expansion apparatus) 122, a compressor 123, and a condenser 124, which will be explained in more detail hereinbelow.

The circulation channel 116 may serve as a path for air, which may flow through the drum 110 and dry an object to be dried, within the cabinet 100. The circulation channel 116 may be in the form of a duct within the cabinet 100 that extends from a front side to a rear side of the cabinet 100. Hereinbelow, it may also be referred to as a circulation duct.

The evaporator 121 and the condenser 124 may be installed in the circulation channel 116. The expansion valve 122 and the compressor 123 may be disposed in a base 130 of the cabinet 100, which may be located outside of the circulation channel 116. The evaporator 121 may be mounted on an upstream side of the circulation channel 116, rather than the condenser 124. Therefore, air introduced from the lint filter mounting portion 112 may flow through the evaporator 121 and the condenser 124 in a sequential manner, while flowing along the circulation channel 116. Accordingly, cooling and reheating of the air may be carried out. That is, the circulation channel 116 may form, within the main body (cabinet 100), a path for air, which has flowed through the drum 110, to be supplied back into the drum 110 after being cooled and reheated.

A back duct 114 may be installed at a downstream side of the circulation channel 116. The back duct 114 may be connected to the circulation channel 114, such that hot air introduced from the circulation channel 116 may be resupplied into the drum 110. In addition, a heater 118 may be placed within the back duct 114 to reheat hot air, which was first heated by the condenser 124. The heater 118 may be driven at an initial time point at which the heat pump system has not reached a normal state, so as to prevent a temperature of the hot air from being too low, or may be used to shorten a drying time by providing additional heat, even when the heat pump system has reached a normal state.

Air which has been heated in the back duct 114 may be supplied into the drum 110, which may be rotated within the cabinet 100 by a drive motor (not shown), thereby drying the object to be dried within the drum 110. The air used for drying may become humid due to moisture contained therein, which has been evaporated from the object to be dried, and may then be discharged to the lint filter mounting portion 112, which may communicate with the front side of the drum 110, close to the door 108, and the circulation channel 116.

Foreign material which may be contained in the humid air may be filtered off by a lint filter (not shown), which may be placed between the front side of the drum 110 and the circulation channel 116. Also, the flow of such air may be realized more efficiently by use of a blowing fan (not shown), which may be placed on or in the circulation channel 116.

The heat pump system 120 may perform heat-exchange with air circulating along the circulation channel 116 so as to cool and heat the air. The heat pump system 120 may be configured by sequentially connecting the evaporator 121, the compressor 123, the condenser 124, and the expansion valve 122 using pipes. Among these components forming the heat pump system 120, the evaporator 121 and the condenser 124 may perform heat-exchange directly with the circulating air. A refrigerant circulating within the heat pump system 120 may be evaporated, as the evaporator 121 adsorbs heat from hot humid air discharged out of the drum 110. Accordingly, the circulating air may be cooled, and moisture contained in the air may be condensed and dropped onto a bottom surface of the duct-shaped circulation channel 116 via gravity.

The refrigerant, which circulates within the heat pump system 120, may be evaporated in the evaporator 121, compressed into a high temperature and high pressure state in the compressor 123, and condensed in the condenser 124 by transferring heat to the cooled circulating air. Accordingly, the circulating air may be heated to be hot dry air, and then discharged back to the drum 110 via the circulation channel 116 and the back duct 114. The cooled refrigerant may be adiabatically expanded in the expansion valve 122 to reach a state capable of adsorbing heat in the evaporator 121 again.

During the cooling process of the circulating air by the evaporator 121, moisture contained in the hot humid air may be condensed onto a surface of the evaporator 121 or drop to a lower side of the evaporator 121. The thusly-generated condensed water may drop onto a bottom surface of the circulation channel 116 located below the evaporator 121 and then be collected.

The base 130 shown in FIG. 3 may be installed on a lower surface of the cabinet 100. The base 130 may include the circulation channel 116, and may provide an installation space to stably support the heat pump system 120. In more detail, the circulation channel 116, in which the evaporator 121 and the condenser 124 may be installed, may be located on one side with reference to FIG. 3 and the expansion valve 122 and the compressor 123 may be located at another side with reference to FIG. 3.

In addition, the lint filter mounting portion 112 may be formed in a front portion, for example, a lower end portion in FIG. 3, of the cabinet 100 and a circulation channel guide 131 may communicate with the lint filter mounting portion 112. The circulation channel guide 131, which may communicate with the lint filter mounting portion 112, may guide hot air discharged from the drum 110 toward the evaporator 121. The circulation channel guide 131 may be provided with a plurality of guide vanes 131*a* to guide introduced air toward the evaporator 121. The hot air guided by the plurality of guide vanes 131*a* may thusly be introduced into the circulation channel 116.

Figure 4:
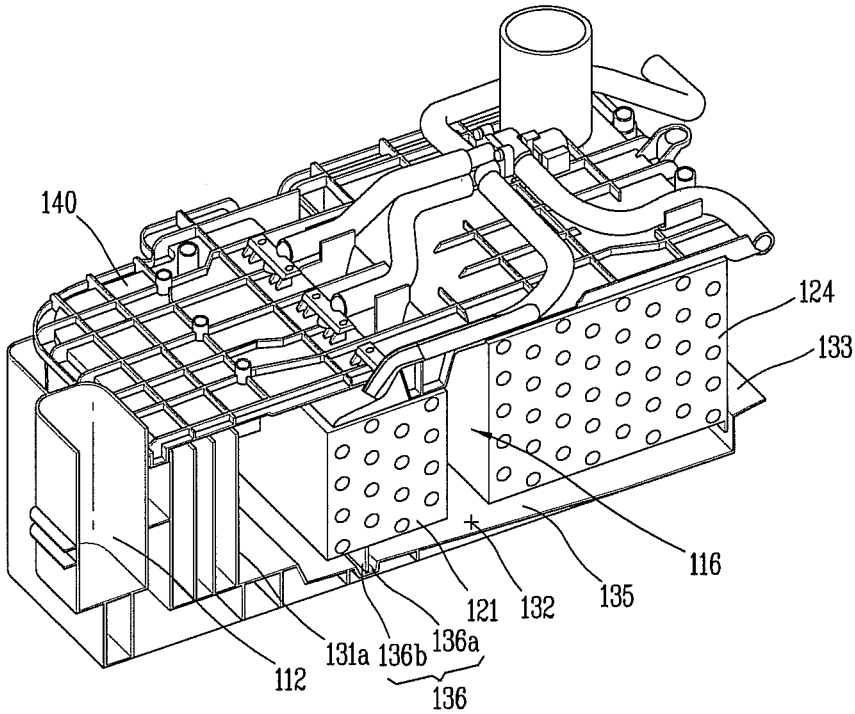
FIG. 4 is a schematic view of a circulation channel according to embodiments.
Figure 5:
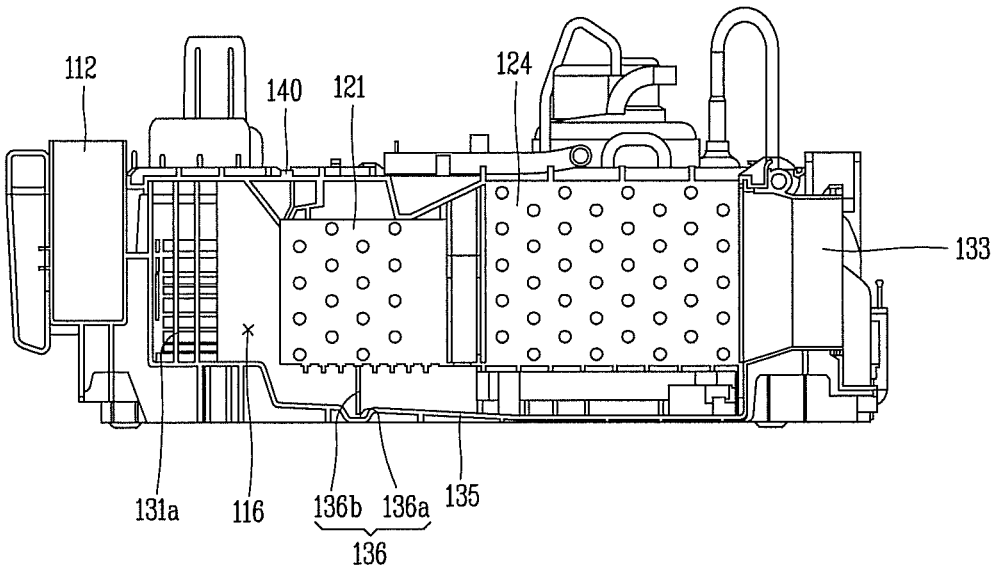
FIG. 5 is a front sectional view of the circulation channel of FIG. 4.

FIG. 4 is a schematic view of the circulation channel according to embodiments, and FIG. 5 is a front sectional view of the circulation channel of FIG. 4. As shown in FIGS. 4 and 5, the circulation channel 116 may be defined by a bottom surface 135, barrier walls (not shown) formed on both sides of the bottom surface 135, and a cover plate 140 that covers an upper portion thereof.

That is, the circulation channel 116 may be in the form of a circulation channel main body including cover plate 140, bottom wall or surface 135, and barrier or side walls. Air, which flows through the thusly-formed circulation channel 116, may flow through the evaporator 121 and the condenser 124 in a sequential manner so as to be introduced into the back duct 114 through a back duct connection portion 133, which may be formed on a rear surface of the base 130.

The bottom surface 135 may decline from an upstream side to a downstream side of the circulation channel 116. Accordingly, the bottom surface 135 may form a moving path 132 for condensed water, which may be generated in the evaporator 121.

The bottom surface 135 may be provided with a 'U'-shaped or 'U' trap 136 disposed below the evaporator 121. The 'U' trap 136 may include a slit 136*a* formed on the bottom surface 135 of the circulation channel 116, and a wall 136*b* that extends down from the lower surface of the evaporator 121 toward the slit 136*a*.

The slit 136*a* may be in the form of a slit on the bottom surface 135 below the evaporator 121, extending from one side surface to another side surface of the circulation channel 116. Accordingly, a portion of the bottom surface 135 of the circulation channel 116 may be lower than its surroundings.

The wall 136*b* may extend from the lower surface of the evaporator 121. The wall 136*b* may extend down into the slit 136*a*. Therefore, the wall 136*b* may be located at a position lower that the bottom surface 135. However, the wall 136*b* may extend so as not to contact a bottom of the slit 136*a*. Accordingly, the slit 136*a* may form a space in a 'U' like shape with the wall 136*b*.

The wall 136*b* may also cross the circulation channel 116 from one side surface to another side surface of the circulation channel 116. Therefore, when viewing a space between the lower surface of the evaporator 121 and the bottom surface 135 of the circulation channel 116 from the upstream side to the downstream side of the circulation channel 116, the circulation channel 116 may be blocked by the bottom surface 135 and the wall 136*b*. However, the circulation channel 116 may not be completely blocked, but may be partially open by a gap between the bottom surface of the slit 136*a* and the wall 136*b*.

As mentioned above, condensed water generated by the evaporator 121 may drop onto the bottom surface 135 and flow along the condensed water moving path 132. The condensed water may be partially introduced into the slit 136*a* to fill the slit 136*a*.

Meanwhile, as the end portion of the wall 136*b* may extend into the slit 136*a*, it may be sunk in the condensed water filled in the slit 136*a*. Therefore, as mentioned above, the space between the lower surface of the evaporator 121 and the bottom surface 135 of the circulation channel 116 may be completely blocked by the wall 136*b* and the condensed water may flow into the slit 136*a*.

As described above, the 'U' trap 136 may be provided on the bottom surface below the evaporator 121 in order to improve condensation efficiency of air, which may flow through the circulation channel 116 to heat-exchange with the evaporator 121. The 'U' trap 136 may prevent air leakage to the lower side of the evaporator 121 located on or in the circulation channel 116, so as to provide an effect of blocking the circulation channel 116, such that most air that flows through the circulation channel 116 may participate in heat-exchange with the evaporator 121.

Also, by efficiently forming the inside of the clothes dryer 1, condensed water, which may be condensed due to heat-exchange with the evaporator 121, may be generated at the side of the evaporator 121 and fill in the 'U' trap 136. This may improve efficiency of the heat pump system 120 using the naturally generated condensed water, without any separate water supply device, resulting in an improvement in energy efficiency of the dryer.

Meanwhile, a portion of the condensed water moving along the condensed water moving path 132 may be collected in the 'U' trap 136, and the rest of the condensed water may move along the inclination of the bottom surface 135 to be introduced into a condensed water storing portion 134 (see FIG. 3) located adjacent to the compressor 123. The condensed water stored in the condensed water storing portion 134 may be separately processed by a pump 150 (see FIG. 3).

Embodiments disclosed herein provide a clothes dryer, capable of improving energy efficiency, by preventing air leakage, such that a lot more air may be used for heat-exchange with an evaporator of a heat pump system, when air used for drying performs heat-exchange with the evaporator and is condensed, in a drying machine having the heat pump system.

Embodiments disclosed herein provide a clothes dryer that may include a main body having a drum rotatably installed therein, a circulation channel formed in the main body, the circulation channel defining a path of air that flows through the drum to dry an object to be dried, and a heat pump system having an evaporator, a compressor, an expansion apparatus, and a condenser, the heat pump system cooling and heating air that flows through the circulation channel. The evaporator may be mounted in the circulation channel, and a 'U' trap may be placed below the evaporator in the circulation channel.

The 'U' trap may include a trap slit formed on a bottom surface of the circulation channel, and a trap layer extending from a lower surface of the evaporator into the trap slit. An end portion of the trap layer may extend to a position lower than the bottom surface. Also, the trap layer may cross the circulation channel from one side surface to another side surface of the circulation channel.

With such a configuration, the 'U' trap may be provided on the bottom surface below the evaporator in order to improve condensation efficiency of air, which flows through the circulation channel heat-exchanging with the evaporator. The 'U' trap may prevent air from being leaked to the lower side of the evaporator located on the circulation channel, so as to provide an effect of blocking the circulation channel, such that most of the air that flows through the circulation channel may participate in heat-exchange with the evaporator.

The bottom surface may be downwardly inclined from an upstream side to a downstream side of the circulation channel. This may allow the bottom surface to define a moving path of condensed water which is generated in the evaporator.

The circulation channel may be formed within the main body from a front side to a rear side of the main body. The evaporator and the condenser may be mounted within the circulation channel to perform heat-exchange with air that flows through the circulation channel. Also, the evaporator may be mounted in an upstream side of the circulation channel, rather than the condenser. Accordingly, the circulation channel may form in the main body an air path through which air that flows through the drum is cooled and heated, and thereafter supplied into the drum.

By efficiently forming an inside of the clothes dryer, water which is condensed due to heat-exchange with the evaporator may be generated at a side of the evaporator and fill in the 'U' trap. This may improve efficiency of the heat pump system using the naturally generated condensed water, without any separate water supply unit or device, resulting in an improvement in energy efficiency of the dryer.

Embodiments disclosed herein may have at least the following advantages.

A clothes dryer according to embodiments disclosed herein may form a 'U' trap on a bottom surface of a circulation channel to improve condensation efficiency of air that flows through the circulation channel, to perform heat-exchange with an evaporator of a heat pump system. Formation of the 'U' trap may prevent air from being leaked to a lower side of the evaporator located on the circulation path, thereby blocking the circulation channel such that most of the air that flows through the circulation channel may be used to heat-exchange with the evaporator. That is, an amount of air which performs heat-exchange with a refrigerant of the heat pump system may increase to improve energy efficiency of the clothes dryer.

Also, by efficiently forming internal structure of the clothes dryer, water, which is condensed by heat-exchange with the evaporator, may be generated at a side of the evaporator so as to fill in the 'U' trap. Accordingly, air in the circulation channel cannot be leaked to a lower side of the evaporator by virtue of the condensed water. This may provide an effect of improving efficiency of the heat pump system using the naturally formed condensed water, without a separate water supply unit or device, which may result in improvement of energy efficiency of the dryer.

The foregoing embodiments and advantages are merely exemplary and are not to be construed as limiting the present disclosure. The present teachings may be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothes dryer, comprising:

a main body having a drum rotatably installed therein;

a circulation channel formed in the main body, wherein the circulation channel defines a path along which air flows through the drum to dry an object to be dried; and a heat pump system having an evaporator, a compressor, an expansion apparatus, and a condenser, wherein the heat pump system cools and heats air that flows through the circulation channel, wherein the evaporator is mounted in the circulation channel, wherein a 'U' trap is provided below the evaporator in the circulation channel, and wherein the 'U' trap includes:

a slit formed on a bottom surface of the circulation channel, wherein the slit temporarily stores condensate flowing downward from the evaporator; and a wall that extends from a lower surface of the evaporator toward the slit, wherein an end portion of the wall extends to a position lower than the bottom surface of the circulation channel and is sunk into the condensate in the slit so as to block air from bypassing the evaporator.

2. The clothes dryer of claim 1, wherein the end portion of the wall extends to a position adjacent to a bottom surface of the slit leaving a gap therebetween.

3. The clothes dryer of claim 1, wherein the wall crosses the circulation channel from a first side surface to a second side surface of the circulation channel.

4. The clothes dryer of claim 1, wherein the bottom surface declines from an upstream side to a downstream side of the circulation channel.

5. The clothes dryer of claim 4, wherein the bottom surface forms a moving path of condensed water generated in the evaporator.

6. The clothes dryer of claim 1, wherein the circulation channel extends within the main body from a front side to a rear side of the main body.

7. The clothes dryer of claim 6, wherein the evaporator and the condenser are mounted within the circulation channel to perform heat-exchange with air that flows through the circulation channel.

8. The clothes dryer of claim 7, wherein the evaporator is mounted at an upstream side of the circulation channel.

9. The clothes dryer of claim 1, wherein the circulation channel forms in the main body an air path through which air that flows through the drum is cooled and heated and thereafter supplied into the drum.

10. A circulation channel for a clothes dryer, the circulation channel comprising:

a circulation channel main body including a cover plate and a bottom wall, that serves as a path for air to flow through a drum and dry an object to be dried;

an evaporator mounted in the circulation channel main body; and a 'U' trap provided below the evaporator in the circulation channel main body, wherein the 'U' trap includes:

a slit formed on a bottom surface of the circulation channel, wherein the slit temporarily stores condensate flowing downward from the evaporator; and a wall that extends from a lower surface of the evaporator toward the slit, wherein an end portion of the wall extends to a position lower than the bottom surface of the circulation channel and is sunk into the condensate in the slit so as to block air from bypassing the evaporator.

11. The circulation channel of claim 10, wherein the end portion of the wall extends to a position adjacent to a bottom surface of the slit leaving a gap therebetween.

12. The circulation channel of claim 10, wherein the wall crosses the circulation channel from a first side surface to a second side surface of the circulation channel.

13. The circulation channel of claim 10, wherein the bottom surface declines from an upstream side to a downstream side of the circulation channel.

14. The circulation channel of claim 13, wherein the bottom surface forms a moving path of condensed water generated in the evaporator.

* * * * *